US007439830B2

(12) United States Patent
Kich

(10) Patent No.: US 7,439,830 B2
(45) Date of Patent: Oct. 21, 2008

(54) CONSTANT CONTACT PRESSURE PIM INTERFACE

(76) Inventor: Rolf Kich, 1624 Harper Ave., Redondo Beach, CA (US) 90278

( * ) Notice: Subject to any disclaimer, the term of this patent is extended or adjusted under 35 U.S.C. 154(b) by 0 days.

(21) Appl. No.: 11/026,685

(22) Filed: Dec. 31, 2004

(65) Prior Publication Data

US 2006/0145790 A1 Jul. 6, 2006

(51) Int. Cl.
*H01P 1/04* (2006.01)

(52) U.S. Cl. ..... 333/234; 333/232; 333/229

(58) Field of Classification Search ..... 333/253–254, 333/229, 245, 234, 232, 235; 439/578
See application file for complete search history.

(56) References Cited

U.S. PATENT DOCUMENTS 4,321,557 A * 3/1982 McNair ..... 372/33
4,450,616 A * 5/1984 Morita ..... 29/446

FOREIGN PATENT DOCUMENTS

JP 03224301 A * 10/1991

* cited by examiner

*Primary Examiner*—Stephen E Jones
(74) *Attorney, Agent, or Firm*—Philip T. Virga

(57) ABSTRACT

An interface that provides minimum changes in contact pressure over a thermal range is disclosed. The interface is a mated joint of given material, typically metallic, joined by a mechanical fastener or fasteners. The fastener(s) create contact pressure at the joint surface wherein the contact pressure variation over a temperature range is minimized by the use of a thermal compensator having a predetermined length. The thermal compensator's length is chosen by setting the thermally induced expansion delta to offset an equal delta created by the fastener and interface configuration. The difference in expansion of the mated joint and fastener is canceled by the equal, but negative, difference between compensator and fastener. This cancellation of expansion minimizes the change in contact pressure at the joint interface. Maintaining a constant pressure provides PIM reliability during temperature changes.

8 Claims, 4 Drawing Sheets

CONSTANT CONTACT PRESSURE PIM INTERFACE

Common transmission lines in coaxial or waveguide form are used to route signals in such a manner as to reliably avoid the production of passive inter-modulation products (hereinafter PIM) during spacecraft satellite operations. Avoidance of PIM with high reliability is accomplished with a high-pressure interface. The high-pressure interface is typically achieved by using high strength bolts. However, a problem arises in that the expansion characteristics of the high strength bolts differ from the expansion characteristics of the interface materials typically in the form of a flange. A common material in use as flange material in space applications is lightweight aluminum. The difference between the expansion of flange materials and fastener materials, over a temperature range, creates a change in contact pressure. Large temperature excursions which are common in space and can occur from self-heating of RF signals as they are routed through the various transmission media. A large change in temperature may compromise the required pressure necessary for PIM avoidance. As an example: a large increase in temperature can create contact pressures high enough to yield and deform the flange joint base material. As the temperature again decreases as is common in the general applications, the yielded, deformed interface will no longer adequately provide the necessary pressure required to suppress PIM. Unreliable PIM performance can seriously jeopardize a satellite's mission.

SUMMARY

A method and apparatus to achieve minimum contact pressure variation of a mated interface during temperature excursions is provided. The mated interface may be a two flange configuration having a plurality of fasteners such as high strength bolts that apply the required pressure. These fasteners are secured using nuts or threads added to one of the flange configurations wherein a temperature compensator in the form of a sleeve is mounted under the nut or head of the fastener. The length of the compensator sleeve is judiciously chosen based on the CTEs of the plurality of materials used wherein a material with a lower CTE than either fastener or flange is chosen for the compensator sleeve. The length is set so that the difference of CTEs of the fastener material and compensator equals the difference of CTEs of the flange material and fastener times the thickness of the flanges. As temperature increases, the lack of expansion of the compensator sleeve compared to the fastener offsets the expansion of flanges compared to the fastener thereby providing a constant contact pressure at the mated interface.

BRIEF DESCRIPTION OF THE DRAWINGS

The drawings are not to scale and are only for purposes of illustration.

DETAILED DESCRIPTION

Figure 1:
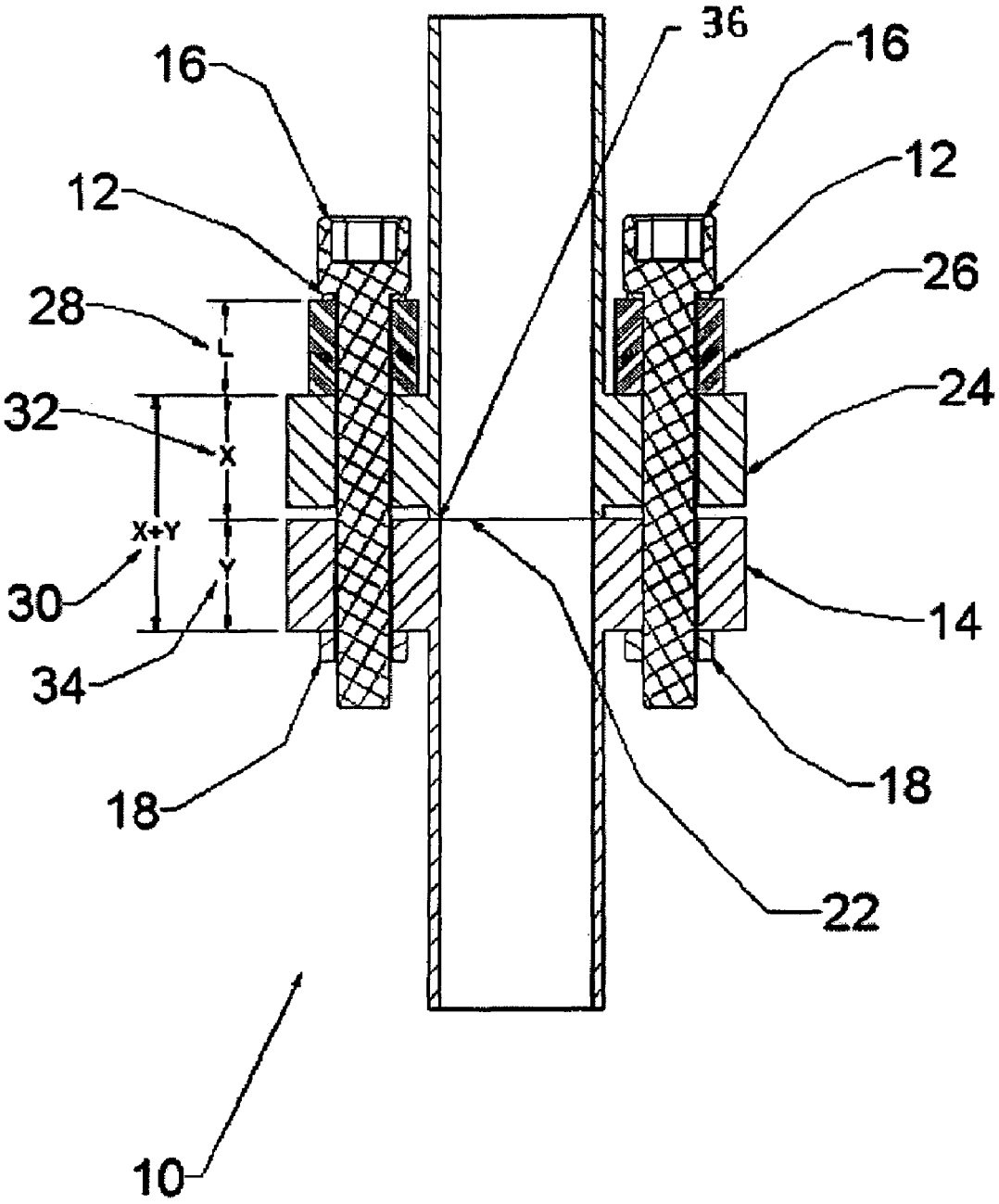
FIG. 1 is a cross-sectional view of a waveguide mating flange interface configuration incorporating a temperature compensator sleeve.

A method and apparatus to achieve minimum contact pressure variation of a mated interface during temperature excursions is provided. The method and apparatus in one embodiment comprises a first configuration in the form of a waveguide flange mated to a second configuration, also in the form of a waveguide flange. Referring now to FIG. 1, there is shown a cross-sectional view of a waveguide mating flange interface configuration 10. The waveguide mating flange interface configuration 10 forms a mated surface 22 by placing a first flange member 24 against a second flange member 14. Flange materials are typically lightweight, with a high coefficient of thermal expansion (CTE). As is known in the fastening arts, a higher pressure is achieved by reducing the surface area by incorporating a raised ridge 36 on one or both flanges 14 and 24, respectively. As shown in FIG. 1, the mated surface 22 is reduced in size thereby forming the pressure ridge 36. This kind of mating structure is basic in design and is in itself conventional and may vary.

The mated configuration further has a plurality of fasteners that apply the required pressure. Referring once again to FIG. 1, fasteners 16, nuts 18 and lock washers 12 are utilized to join the first flange member 14 against the second flange member 24 at raised ridges 36 thereby forming the mated surface 22. As is common in the art, the fasteners 16 are in the form of high strength bolts. These are fastened with nuts 18 or may be fastened using threads (not shown) added to one of the flange configurations. The fasteners 16, nuts 18 and lock washers 12 are used to provide contact pressure at the raised ridge contact points 36 as well as holding the two flange members together at the mated surface 22. By way of example only and not of limitation, the material of the first flange member 12 and second flange member 14 may be made of aluminum. The fastener(s) 16, nut(s) 18 and lock washer(s) 12 are preferably made of a high strength material and may be by way of example only may be stainless steel. It should be understood that a plurality of fastener types and threaded methods may be used to obtain the desired pressure.

The waveguide mating flange interface configuration 10 further incorporates one or more temperature compensator(s) 26 in the form of a sleeve mounted under the nut or head of one or more of the fastener(s) 16. When the waveguide mating flange interface 10 shown in FIG. 1 is used in typical fashion, exposure to increasing temperatures expands the materials of the first flange member 24, second flange member 14 and fastener(s) 16 as determined by these material's characteristic thermal coefficient of expansion (CTE). The greater expansion of the aluminum material of the first flange member 24 and second flange member 14 is restricted by the lower expansion of the fastener(s) 16. The combination of greater versus lower expansion rates increases the pressure applied at the raised ridge 36 contact point. As temperature rises, the pressure at the raised ridge 36 contact point may increase to a level higher than the yield strength of the aluminum flange material of the first flange material 24. As the temperature returns to a lower level, the yielded material of the first flange member 24 remains compressed. Therefore, the pressure applied at the raised ridge 36 contact point is reduced to a value lower than the initial level resulting in the generation of unwanted passive intermodulation signals.

To reliably avoid or suppress the production of these passive intermodulation (PIM) signals, the contact pressure at the raised ridge 36 must be maintained above a critical level. In order to achieve and maintain this critical level, one or more thermal compensator(s) or sleeve(s) 26 having a predetermined length L 28 are provided. The compensator sleeve(s) 26 with calculated length L 28 are used to offset the difference of CTE's between the materials of the first and second flange members, 24 and 14, respectively and the material of the fastener(s) 16. The material used for the compensator sleeve(s) 26 are chosen to have a lower CTE than the material of the fastener(s) 16 for temperature ranges that generally increase.

The compensator sleeve(s) 28 length "L" are determined by the relationship shown in Equation 1 where CTE is expressed in ppm/degF and X,Y and L are in inches:

$$L = \frac{|CTE_{Flange} - CTE_{Fastener}|}{|CTE_{Compensator} - CTE_{Fastener}|} * (X + Y) \qquad \text{Equation 1}$$

By way of example only when:

X=0.200 inches and y=0.200 inches with the

CTE flange=13.4, CTE fastner=10.5 and CTE invr=1.2, then

L=[(13.4−10.5)/(10.5−1.2)]×(0.2+0.2)=0.4 inches

As shown in FIG. 1, the total thickness X 32 of the first flange member 24 is added to the total thickness Y 34 of the second flange member 14 resulting in a total "X"+"Y" thickness 30. The compensator(s) length L 28 is calculated from the subtracted difference of the CTE's of the flanges, 24 and 14 and fastener(s) 16 must equal the subtracted difference of the fastener(s) 16 and the thermal compensator(s) 26 times the length "X+Y" 30.

The relationship of equation 1 determines that the length of the compensator sleeves 26 be judiciously chosen based on the CTEs of the materials used wherein a material with a lower CTE than either fastener or flange is chosen for the compensator. The length is set so that the difference of CTEs of the fastener material and compensator equals the difference of CTEs of the flange material and fastener times the thickness of the flanges. As temperature increases, the lack of expansion of the compensator compared to the fastener offsets the expansion of flanges compared to the fastener. By way of example, the material of the compensator sleeve(s) 26 may be made from a nickel steel material known by the trade name invar. Additionally, it should be noted although not shown, that the compensator sleeve(s) 26 may be added at either end of the fastener(s) 16 or at each location.

In practice for a general increase in temperature, the fastener(s) 16 grow in length compared to the compensator sleeve(s) 26. The fastener(s) 16 fail to grow in length compared to the combined thickness 30 of the first flange member 24 and second flange member 14. But, the shortage in length is exactly compensated for by the excess growth in length of the fastener(s) 16 compared to the compensator sleeve(s) 26. Pressure is thus maintained at a constant level during an increase in temperature. A general decrease in temperature requires a material choice for the compensator sleeve 26 with a CTE greater than the fastener 16 material. As is common in the art, threaded nuts 18 are, on occasion, replaced by threads in one flange member 14. The compensator sleeve 26 length "L" required would decrease since the difference of CTE that needs to be offset in this case, is only over the distance "X" instead of "X"+"Y".

Figure 2:
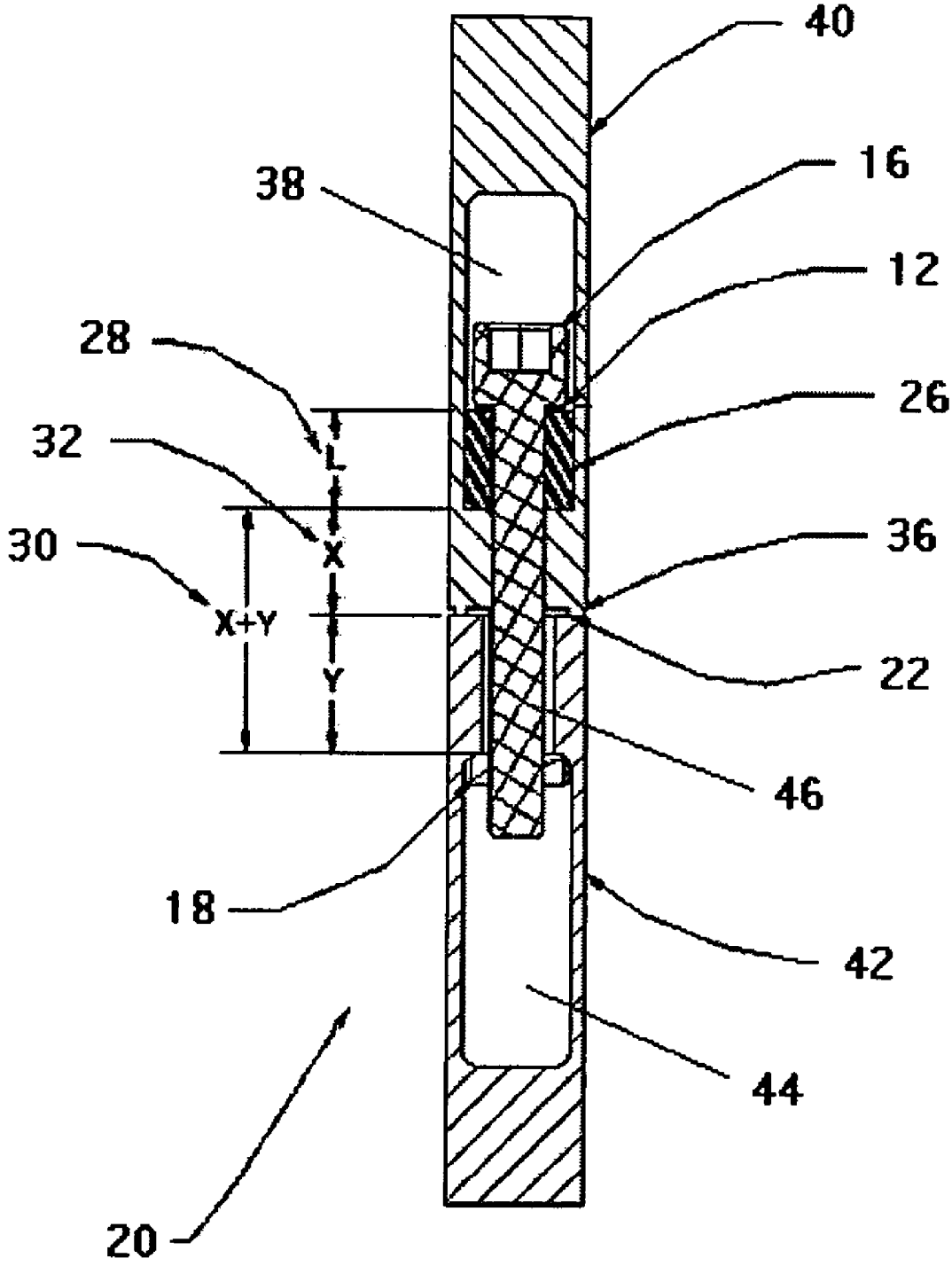
FIG. 2 is a cross-sectional view of a coaxial center conductor of a square waveguide incorporating a temperature compensator sleeve.

In another embodiment, FIG. 2 shows a cross-sectional view of a coaxial center conductor mating configuration 20 which is part of a square waveguide coaxial assembly. As shown in FIG. 2, a first coaxial center conductor portion 40 and a second, axially oriented, coaxial center conductor portion 42, defines the coaxial center conductor mating configuration 20 having a mating surface 22. The outer surrounding conductor portion of the square waveguide coaxial assembly is not shown for clarity. The first coaxial center conductor portion 40 defines a relief recess 38 cut out of a side to allow space to insert a fastener 16 and lock washer 12. The second coaxial center conductor portion 42 defines an axial hole 46 and defines a relief recess 44 cut out of its side to allow space to insert a nut 18. In this embodiment the mated configuration once again utilizes the fastener 16 to apply the required pressure at a raised ridge 36 contact point.

Referring once again to FIG. 2, fasteners 16, nuts 18 and lock washers 12 are once again utilized to join the first coaxial center conductor portion 40 against the second coaxial center conductor portion 42 at raised ridges 36 thereby forming the mated surface 22. As described above the fastener 16 is in the form of high strength bolts. These are fastened with nuts 18 or may be fastened using threads (not shown) added to one of the flange configurations. The fasteners 16, nuts 18 and lock washers 12 are used to provide contact pressure at the raised ridge contact points 36 as well as holding the two mating configurations together at the mated surface 22. By way of example only and not of limitation, the material of the first flange member 12 and second flange member 14 also may be made of aluminum. The fastener 16, nut 18 and lock washer 12 are also preferably made of a high strength material and may be by way of example only may be stainless steel. It should be understood that a plurality of fastener types and threaded methods may be used to obtain the desired pressure.

The coaxial center conductor mating configuration 20 incorporates the temperature compensator 26 in the form of a sleeve mounted under the nut or head of the fastener 16. When the coaxial center conductor mating configuration 20 shown in FIG. 2 is used in typical fashion, exposure to increasing temperatures expands the materials of the first coaxial center conductor portion 40, second coaxial center conductor portion 42 and fastener 16 as determined by these material's characteristic thermal coefficient of expansion (CTE). The greater expansion of the aluminum material of the first coaxial center conductor portion 40 and second coaxial center conductor portion 42 is restricted by the lower expansion of the fastener(s) 16. The combination of greater versus lower expansion rates increases the pressure applied at the raised ridge 36 contact point. As temperature rises, the pressure at the raised ridge 36 contact point may increase to a level higher than the yield strength of the aluminum flange material of the first coaxial center conductor portion 40. As the temperature returns to a lower level, the yielded material of the first coaxial center conductor portion 40 remains compressed. Therefore, the pressure applied at the raised ridge 36 contact point once again is reduced to a value lower than the initial level resulting in the generation of unwanted passive intermodulation signals.

Once again the relationship of equation 1 determines that the length of the compensator sleeves 26 be judiciously chosen based on the CTEs of the materials used wherein a material with a lower CTE than either fastener or center conductor portion is chosen for the compensator. The length is set so that the difference of CTEs of the fastener material and compensator equals the difference of CTEs of the coaxial center conductor portions material and fastener times the thickness of the coaxial center conductor portions. As temperature increases, the lack of expansion of the compensator compared to the fastener offsets the expansion of coaxial center conductor portions compared to the fastener. Referring once again to FIG. 2, the length X 32 of the first coaxial center conductor portion 40 is added to the lengthl Y 34 of the second coaxial center conductor portion 42 resulting in a total "X"+"Y" length 30. The compensator sleeve length L 28 is calculated from the subtracted difference of the CTE's of the coaxial center conductor portions, 40 and 42, respectively and fastener 16 must equal the subtracted difference of the fastener 16 and the thermal compensator 26 times the length "X+Y" 30.

Figure 3:
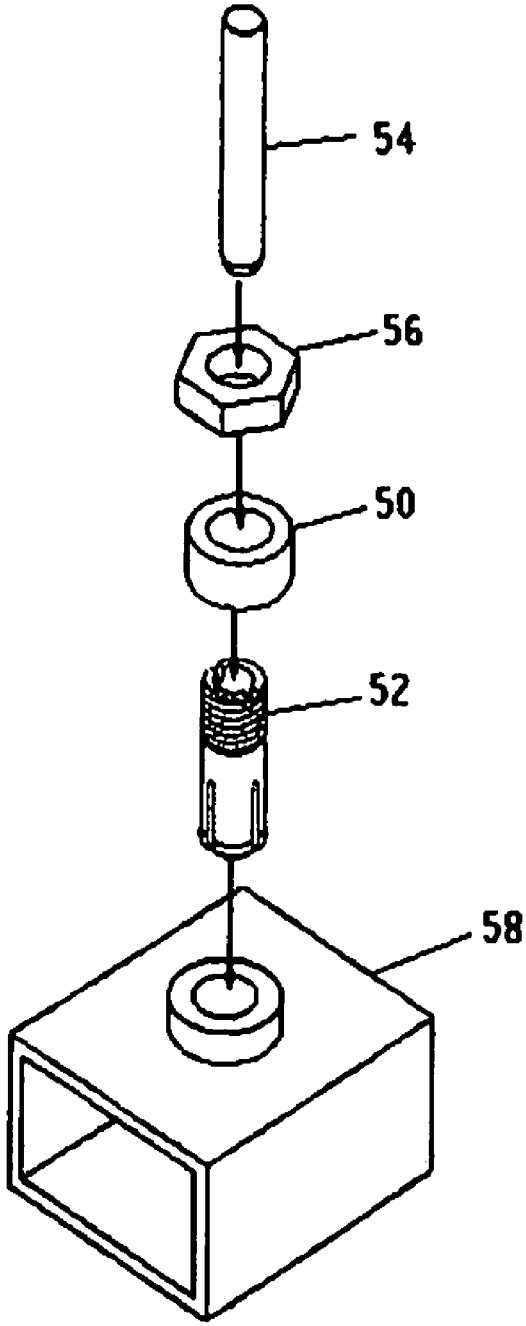
FIG. 3 is an exploded isometric view of a collet sleeve used to prevent PIM.
Figure 4:
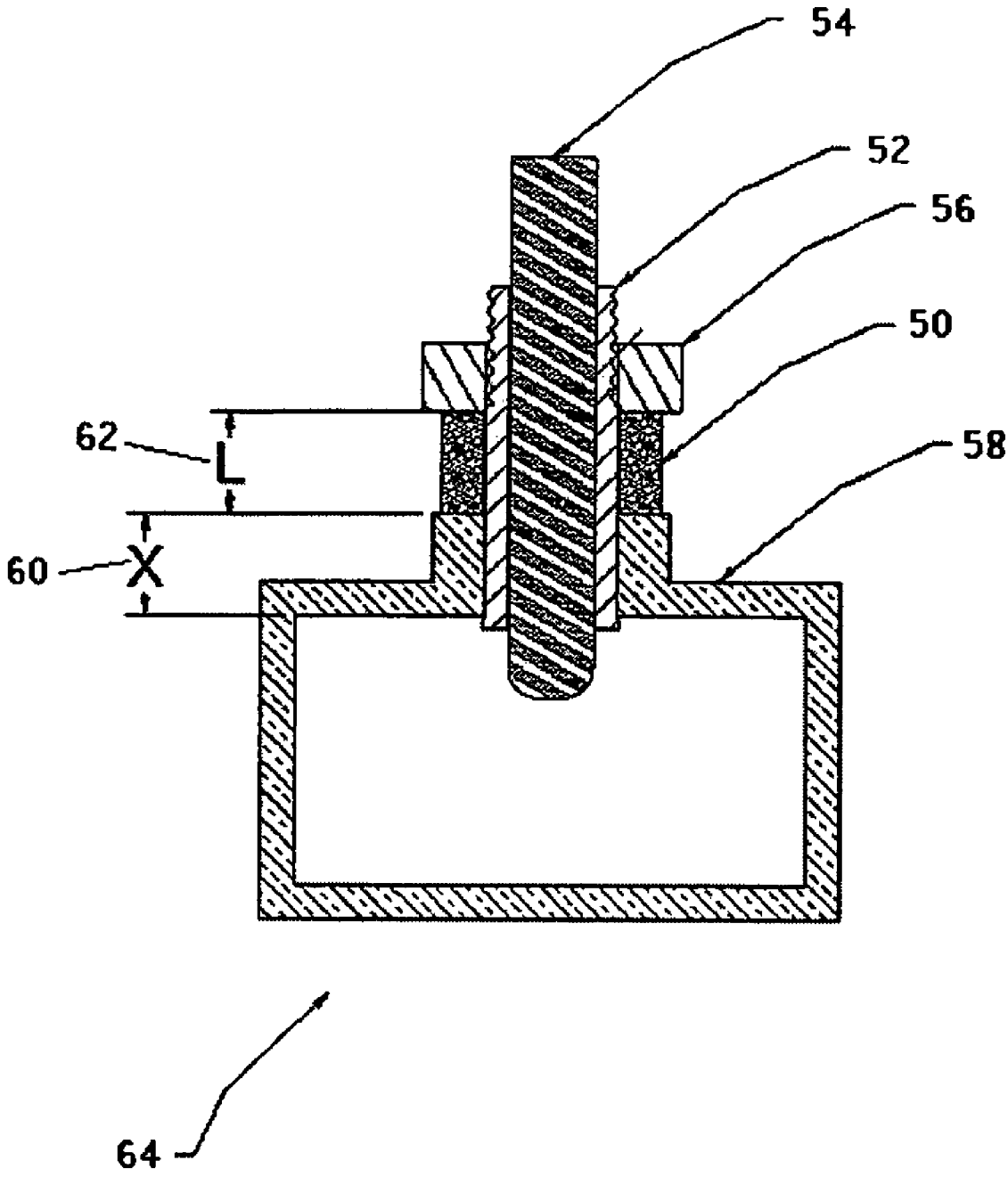
FIG. 4 is a cross-sectional view of the collet sleeve configuration shown in FIG. 3.

Referring now to FIGS. 3 and 4, there is shown a collet sleeve 50 used to prevent PIM. The collet sleeve 50 is typically of a high strength material of a different CTE than the body 52 and pin 54. When the nut 56 is tightened, the angled edges form a pressure seal around the pin 54 and the housing 58. This is again subject to a change in applied pressure as the temperature changes. The addition of the compensator sleeve 50 will correct this situation. The thickness 62 of the sleeve 50 is again determined by the difference of CTEs with the existing formula. The value (X+Y) in this case is just X 60, since there is only one body piece.

The method and apparatus may be embodied in other specific forms without departing from its spirit or essential characteristics. The described embodiments are to be considered in all respect only as illustrative and not restrictive. One experienced in the art can easily refine combinations of materials with the proper CTEs and a mix of the various techniques described to achieve a variety of solutions that result in minimum pressure variation during temperature excursions.

The scope of the invention is, therefore, indicated by the appended claims, rather than by the foregoing description. All changes which come within the meaning and range of equivalency of the claims are to be embraced within their scope.

What is claimed is:

1. A constant contact pressure passive inter-modulation interface comprising:

a collet sleeve located within a housing and pin fastener combination wherein when a nut is tightened angled edges form a pressure seal around said pin and said housing and said configuration utilizing a defined thermal pressure compensator.

2. The interface according to claim 1 wherein the thermal pressure compensator is made from invar.

3. The interface according to claim 1 further comprising angled edges for connection as a passive inter-modulation sensitive device.

4. The interface according to claim 1 further comprising a configuration of mated pieces of materials and fastener with given expansion characteristics.

5. The interface according to claim 4 wherein said angled edges further comprises a fastening member for a high-pressure interface.

6. The interface according to claim 1 wherein said interface further comprises of a thermal pressure compensator comprised of a material of lower thermal expansion.

7. The interface according to claim 6 wherein said thermal pressure compensator length is chosen to offset changes in expansion of said mated configuration.

8. The interface according to claim 6 wherein said thermal pressure compensator length is chosen so that difference in expansion coefficients of fastener and mated materials equals the difference of expansion coefficients of the thermal compensator and fastener.

* * * * *